US007749044B1

(12) United States Patent
Herglotz

(10) Patent No.: US 7,749,044 B1
(45) Date of Patent: Jul. 6, 2010

(54) MANUALLY OPERATED CONSTANT POWER AIR-DRIVEN TOY MUSIC BOX

(76) Inventor: Harald Herglotz, 5006 7th Ct. East, Tuscaloosa, AL (US) 35405

( * ) Notice: Subject to any disclaimer, the term of this patent is extended or adjusted under 35 U.S.C. 154(b) by 282 days.

(21) Appl. No.: 11/859,872

(22) Filed: Sep. 24, 2007

(51) Int. Cl.
*A63H 1/28* (2006.01)
*A63H 5/00* (2006.01)
*G10F 1/06* (2006.01)

(52) U.S. Cl. ..... 446/265; 446/213; 446/217; 446/297; 446/397; 84/94.1; 84/95.2

(58) Field of Classification Search ..... 446/213–218, 446/236, 265, 266, 297, 303, 397; 84/94.1–96, 84/101
See application file for complete search history.

(56) References Cited

U.S. PATENT DOCUMENTS

| | | | | | |
|---|---|---|---|---|---|
| 695,689 | A | * | 3/1902 | Leyson | 446/213 |
| 1,155,263 | A | * | 9/1915 | Naito | 446/218 |
| 1,583,881 | A | * | 5/1926 | Heberling | 446/218 |
| 1,994,202 | A | * | 3/1935 | Sarsfield | 446/186 |
| 2,495,365 | A | * | 1/1950 | Cohn | 84/94.2 |
| 3,392,481 | A | * | 7/1968 | Lee | 446/213 |
| 3,455,051 | A | * | 7/1969 | Genin | 446/408 |
| 3,619,936 | A | * | 11/1971 | Tauriello | 446/216 |
| 4,466,327 | A | | 8/1984 | Hinton | |
| 4,758,197 | A | * | 7/1988 | Lee | 446/213 |
| 4,872,387 | A | * | 10/1989 | Melia | 84/95.2 |
| 5,238,439 | A | * | 8/1993 | Greene et al. | 446/213 |
| 5,334,797 | A | * | 8/1994 | Niedge | 84/95.1 |
| 5,368,515 | A | * | 11/1994 | Mast | 446/217 |
| D505,471 | S | | 5/2005 | Caramico | |

* cited by examiner

*Primary Examiner*—Gene Kim
*Assistant Examiner*—Scott Young
(74) *Attorney, Agent, or Firm*—Kenneth M. Bush; Gerald M. Walsh; Bush Intellectual Property Law

(57) ABSTRACT

A manually operated air-driven music box which will generate music at a relatively constant tempo as a user moves the music box back and fourth in opposite directions through the air. The music box has a rotatable drum cylinder to activate tone arms. A first propeller on one end of a drive axle and a second propeller on an opposite end of the drive axle rotate the drive axle as the music box is moved through the air. A gear mechanism for the drive axle rotates the drum cylinder in the same direction as the drive axle is rotated by the propellers. The first propeller is constructed to rotate in a counterclockwise direction and the second propeller is constructed to rotate in a clockwise direction.

6 Claims, 2 Drawing Sheets

MANUALLY OPERATED CONSTANT POWER AIR-DRIVEN TOY MUSIC BOX

BACKGROUND OF THE INVENTION

1. Field of the Invention

The present invention relates to toy music boxes and, particularly, to toy music boxes powered by the motion of air.

2. Technical Background

Toy music boxes that are driven by an air actuated propeller are known. Generally these devices are held in a stationary position while a continuous motion of ambient air turns a propeller and rotates a drum cylinder inside the music box at a speed proportional to the speed of the air to produce music. If air speed is variable the tempo of the music is variable. If there is no motion of ambient air, the propeller can be activated by a user moving the music box through the air manually, but it is extremely difficult, if not impossible to generate a relatively constant rotation of the drum cylinder. The resulting music has an unacceptable variation in tempo which is unsuitable for the intended purpose of the music box. Heretofore there has been no practical means to govern the power transmitted to the drum cylinder in a toy music box to produce a constant tempo melody as the music box is moved manually back and fourth through the air by the user.

SUMMARY OF THE INVENTION

The present invention is an air powered music box that is manually operated. The music box has a rotatable drum cylinder with projections to activate tone arms to produce music. A drive axle rotates the drum cylinder at a desired rate through a system of four gears. A first propeller is mounted on one end of the drive axle and a second propeller is mounted rotatably on the opposite end of the drive axle. The first propeller is constructed to rotate in a counterclockwise direction in response to movement of the music box through the air by a user. When the first propeller is moved through the air by a user, such that the first propeller provides the power to rotate the drive axle, the second propeller acts as a governor to maintain a relatively constant rate of rotation of the drive axle. When the second propeller is moved through the air by a user, such that the second propeller provides the power to rotate the drive axle, the first propeller acts as a governor to maintain a relatively constant rate of rotation of the drive axle. Thus, as a user moves the music box back and fourth in opposite directions through the air the music box will generate music at a relatively constant tempo. The music box can have flexible handle to move the music box through the air. The flexible handle will further dampen variations in speed of rotation of the drive axle, further providing a constant tempo of the music.

An advantage of the present invention is a music box that can be operated manually.

Another advantage is a music box that can produce music with a relatively constant tempo.

Another advantage is a music box that can be powered by a pair of simple propellers.

Another advantage is a music box that is inexpensive to construct and which can be shaped into an unlimited number of ornamental designs with any desired melody.

DETAILED DESCRIPTION OF THE PREFERRED EMBODIMENTS

Figure 1:
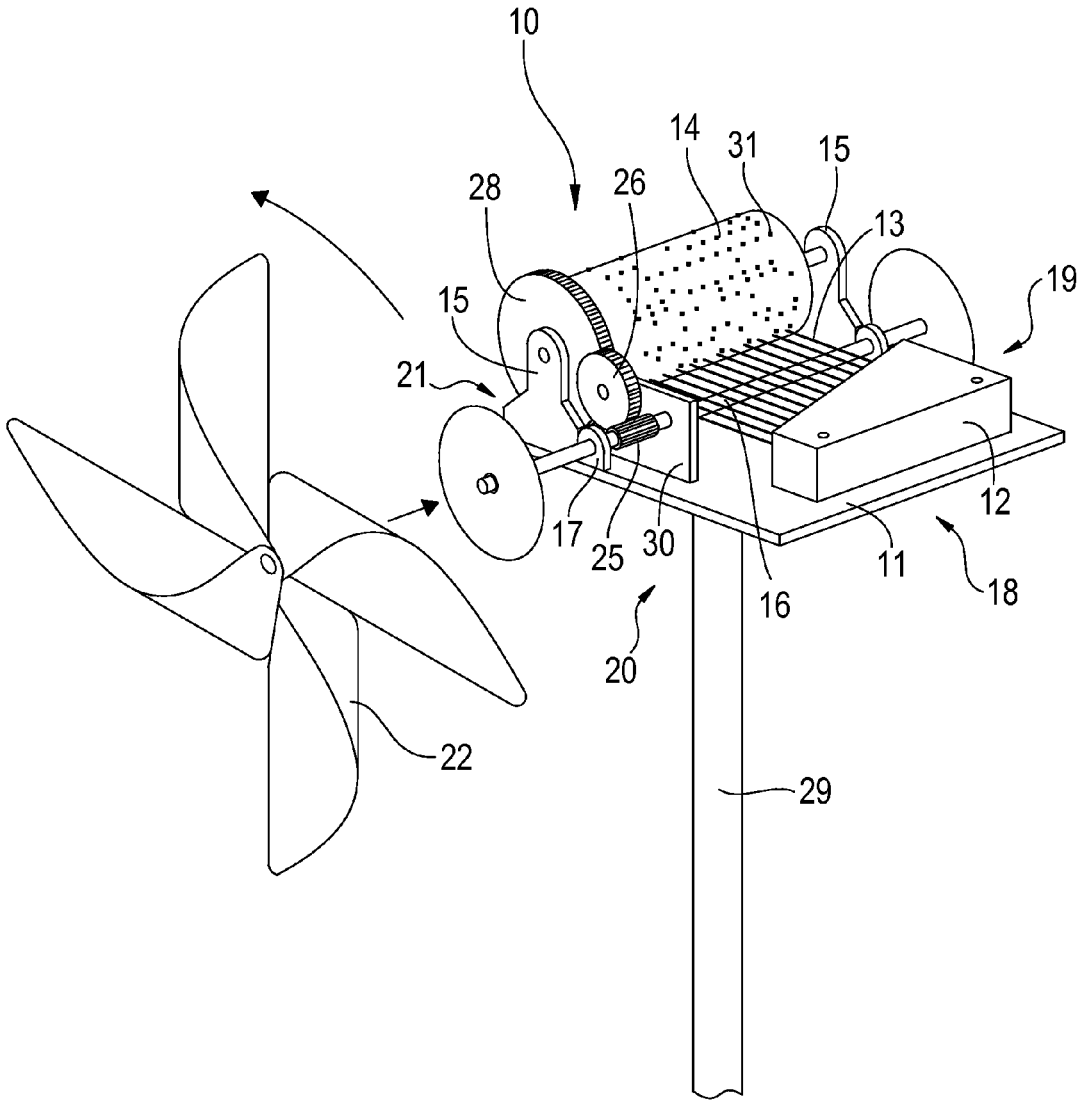
FIG. 1 shows a left front perspective view of the music box of the present invention.

FIG. 1 shows a left front perspective view of the music box 10 of the present invention. Music box 10 has a front end 18, a rear end 21, a left side 20, and a right side 19. Music box 10 has a tone arm bracket 12 with a plurality of tone arms 13. The tone arm bracket is attached to the floor 11 of a housing 24 near front end 18 (see FIG. 2). Music box 10 also has a rotatable drum cylinder 14 which has a plurality of teeth 31 on its surface. As drum cylinder 14 rotates, the teeth 31 strike the tone arms 13 in a desired sequence to produce a desired melody. Drum cylinder 14 is attached rotatably to a pair of brackets 15 which are attached to floor 11 near rear end 21. A drive axle 16 is attached rotatably to brackets 17 which are attached to floor 11 between tone arm bracket 12 and drum cylinder 14. Drive axle 16 has a first gear 25 near left side 20. First gear 25 engages a second gear 26. Second gear 26 is attached rotatably to bracket 30 which is attached to floor 11. Second gear 26 has a third gear 27 which is attached concentrically to second gear 26 (see FIG. 2). Second gear 26 engages a fourth gear 28 which is attached to drum cylinder 14 near left side 20. A handle 29 is attached to floor 11. Propellers are attached to each end of drive axle 16. FIG. 1 shows propeller 22, which is constructed to rotate counterclockwise as it is moved through the air, attached to one end of drive axle 16 near left side 20. A second propeller 23, which is constructed to rotate clockwise as it is moved through the air (see FIG. 3), is attached to the opposite end of drive axle 16 near right side 19.

Figure 2:
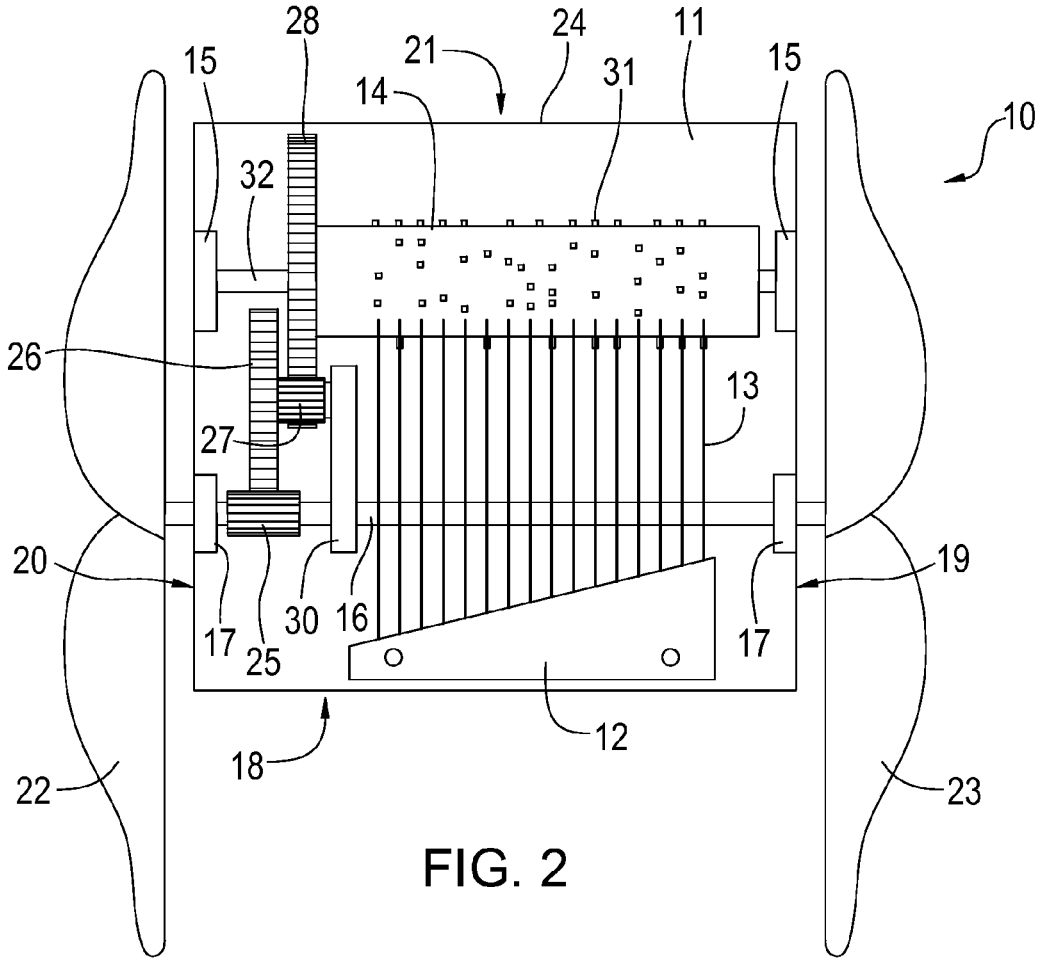
FIG. 2 shows a top view of the music box.

FIG. 2 shows a top view of music box 10, further showing housing 24, drum axle 32, third gear 27, and propeller 23 which is attached to axle 16 near right side 19. As music box 10 is moved either right or left through the air, propellers 22 and 23 will rotate axle 16 towards drum cylinder 14, thus rotating first gear 25 towards drum cylinder 14. As second gear 26 engages first gear 25, first gear 25 will rotate second gear 26 away from drum cylinder 14. Since third gear 27 is attached concentrically to second gear 26, third gear 27 also rotates away from drum cylinder 14. As fourth gear 28 engages third gear 27, third gear 27 will rotate fourth gear 28 in the same direction as drive axle 16. Thus, as propellers 22 and 23 rotate as music box 10 is moved through the air, drum cylinder 14 will rotate towards rear end 21 which will cause teeth 31 on drum cylinder 14 to strike tone arms 13 to produce a given melody resulting from the positioning of teeth 31.

Figure 3:
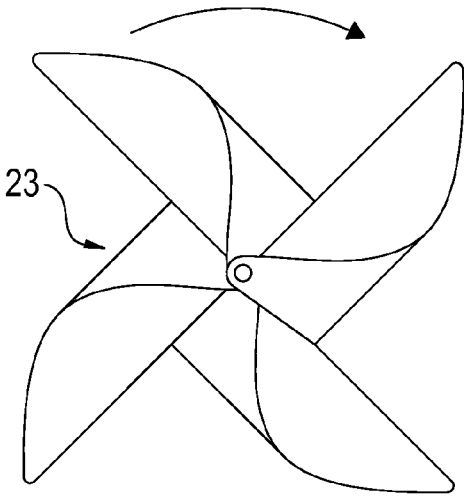
FIG. 3 shows a first propeller that powers the drive axle by rotating in one direction.
Figure 4:
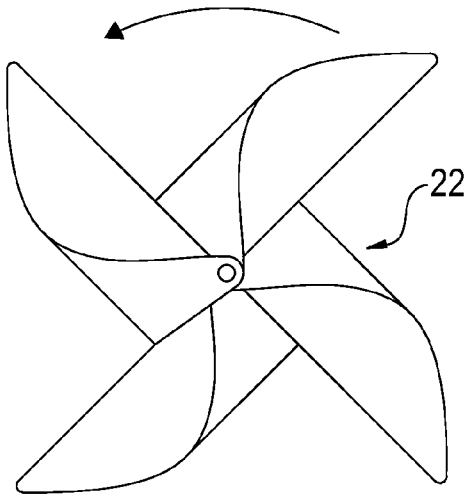
FIG. 4 shows a second propeller that powers the drive axle by rotating in an opposite direction of the first propeller.

FIGS. 2 and 3 show the design of the first left side propeller 22 and the second right side propeller 23. The first propeller is constructed to rotate in a counterclockwise direction in response to movement of the music box through the air by a user. When the first propeller 22 is moved through the air by a user such that the first propeller 22 provides the power to rotate the drive axle, the second propeller 23 acts as a governor to maintain a relatively constant rate of rotation of the drive axle 16. When the second propeller 23 is moved through the air by a user such that the second propeller 23 provides the power to rotate the drive axle 16, the first propeller 22 acts as a governor to maintain a relatively constant rate of rotation of the drive axle 16. Thus, as a user moves the music box 10 back and fourth in opposite directions through the air the music box 10 will generate music at a relatively constant tempo. The music box 10 can have a flexible handle 29 to move the music box 10 through the air. The flexible handle 29 will further dampen variations in speed of rotation of the drive axle 16, further providing a constant tempo of the music created when the teeth 31 engage the tone arms 13.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, music box 10 can be constructed of plastic, metal, wood, or a combination thereof. Drive axle 16 can be driven in a rearward or frontward direction as desired. Music Box 10 and the propellers 22 and 23 can be in any shape and size desired.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A manually operated air-driven music box, comprising:

a) a rotatable drum cylinder to activate tone arms;

b) a first propeller on one end of a drive axle and a second propeller on an opposite end of said drive axle to rotate said drive axle as said music box is moved through the air;

c) a gear mechanism for said drive axle to rotate said drum cylinder in the same direction as said drive axle as said drive axle is rotated by said propellers; and d) said first propeller being constructed to rotate in a counterclockwise direction and said second propeller being constructed to rotate in a clockwise direction, wherein when said first propeller is moved through the air such that said first propeller provides the power to rotate said drive axle, said second propeller acts as a governor to maintain a relatively constant rate of rotation of said drive axle, and when said second propeller is moved through the air such that said second propeller provides the power to rotate said drive axle, said first propeller acts as a governor to maintain a relatively constant rate of rotation of said drive axle, thus producing a relatively constant tempo of music.

2. The music box according to claim 1 wherein said gear mechanism comprises:

a) a first gear on said drive axle;

b) a second gear engaging said first gear, said first gear rotating said second gear in a direction opposite to the direction of said propeller, said drive axle, and said first gear;

c) a third gear attached concentrically to said second gear and rotating in the same direction as said second gear; and d) a fourth gear on said drum cylinder, said fourth gear engaging said third gear, said third gear rotating said fourth gear in the same direction as said drive axle.

3. The music box according to claim 1, comprising a flexible handle to dampen variations in speed of rotation of the drive axle, further providing a relatively constant tempo of the music.

4. A manually operated air-driven music box, comprising:

a) a rotatable drum cylinder to activate tone arms;

b) a first propeller on one end of a drive axle and a second propeller on an opposite end of said drive axle to rotate said drive axle as said music box is moved through the air;

c) a gear mechanism for said drive axle to rotate said drum cylinder in the same direction as said drive axle as said drive axle is rotated by said propellers, wherein said gear mechanism comprises:

1) a first gear on said drive axle;

2) a second gear engaging said first gear, said first gear rotating said second gear in a direction opposite to the direction of said propeller, said drive axle, and said first gear;

3) a third gear attached concentrically to said second gear and rotating in the same direction as said second gear; and 4) a fourth gear on said drum cylinder, said fourth gear engaging said third gear, said third gear rotating said fourth gear in the same direction as said drive axle; and d) said first propeller being constructed to rotate in a counterclockwise direction and said second propeller being constructed to rotate in a clockwise direction, wherein when said first propeller is moved through the air such that said first propeller provides the power to rotate said drive axle, said second propeller acts as a governor to maintain a relatively constant rate of rotation of said drive axle, and when said second propeller is moved through the air such that said second propeller provides the power to rotate said drive axle, said first propeller acts as a governor to maintain a relatively constant rate of rotation of said drive axle, thus producing a relatively constant tempo of music.

5. The music box according to claim 4, comprising a flexible handle to dampen variations in speed of rotation of the drive axle, further providing a relatively constant tempo of the music.

6. A manually operated air-driven music box, comprising:

a) a rotatable drum cylinder to activate tone arms;

b) a first propeller on one end of a drive axle and a second propeller on an opposite end of said drive axle to rotate said drive axle as said music box is moved through the air;

c) a gear mechanism for said drive axle to rotate said drum cylinder in the same direction as said drive axle as said drive axle is rotated by said propellers, wherein said gear mechanism comprises:

1) a first gear on said drive axle;

2) a second gear engaging said first gear, said first gear rotating said second gear in a direction opposite to the direction of said propeller, said drive axle, and said first gear;

3) a third gear attached concentrically to said second gear and rotating in the same direction as said second gear; and 4) a fourth gear on said drum cylinder, said fourth gear engaging said third gear, said third gear rotating said fourth gear in the same direction as said drive axle;

d) said first propeller being constructed to rotate in a counterclockwise direction and said second propeller being constructed to rotate in a clockwise direction, wherein when said first propeller is moved through the air such that said first propeller provides the power to rotate said drive axle, said second propeller acts as a governor to maintain a relatively constant rate of rotation of said drive axle, and when said second propeller is moved through the air such that said second propeller provides the power to rotate said drive axle, said first propeller acts as a governor to maintain a relatively constant rate of rotation of said drive axle, thus producing a relatively constant tempo of music; and e) a flexible handle to dampen variations in speed of rotation of the drive axle, providing a further relatively constant tempo of the music.

* * * * *